United States Patent [19]

Connors et al.

[11] Patent Number: 4,794,878

[45] Date of Patent: Jan. 3, 1989

[54] ULTRASONICS TRAVELING WAVE FOR TONER TRANSPORT

[75] Inventors: Edward W. Connors, Rochester; Paul C. Julien, Webster; Robert G. Martin, Rochester, all of N.Y.

[73] Assignee: Xerox Corporation, Stamford, Conn.

[21] Appl. No.: 81,272

[22] Filed: Aug. 3, 1987

[51] Int. Cl.[4] ..... G03G 15/08

[52] U.S. Cl. ..... 118/653; 118/655; 118/612; 355/3 DD; 222/DIG. 1; 198/766

[58] Field of Search ..... 118/653, 308, 312, 612, 118/655; 427/57; 355/3DD; 222/DIG. 1; 198/766

[56] References Cited

U.S. PATENT DOCUMENTS

| | | | |
|---|---|---|---|
| 3,472,431 | 10/1969 | Bodine, Jr. | 198/766 X |
| 3,511,214 | 5/1970 | Hodges | 118/655 X |
| 3,536,043 | 10/1970 | Eppe et al. | 118/312 X |
| 3,550,555 | 12/1970 | Hudson | 118/312 X |
| 3,637,115 | 1/1972 | Holm | 222/195 |
| 3,639,050 | 2/1972 | Staller | 355/3 DD |
| 3,973,517 | 8/1976 | Hudson | 118/312 X |
| 4,188,907 | 2/1980 | Lipani | 118/657 |
| 4,444,864 | 4/1984 | Takahashi | 118/658 X |
| 4,481,903 | 11/1984 | Haberhauer et al. | 118/658 X |
| 4,527,884 | 6/1985 | Nusser | 355/3 DD |
| 4,546,722 | 10/1985 | Toda et al. | 118/657 |
| 4,558,941 | 12/1985 | Nosaki et al. | 355/3 DD |
| 4,562,374 | 12/1985 | Sashida | 310/328 |

FOREIGN PATENT DOCUMENTS

| | | | |
|---|---|---|---|
| 0861208 | 9/1981 | U.S.S.R. | 198/630 |

*Primary Examiner*—Shrive Beck
*Assistant Examiner*—Alain Bashore
*Attorney, Agent, or Firm*—Ronald F. Chapuran

[57] ABSTRACT

The invention is a single component development system including a housing with a sump containing a supply of toner, an ultrasonic transducer having one end extending into the source of the toner and the other end disposed adjacent a photoreceptor, and a current source electrically connected to the ultrasonic transducer to charge the toner and move the toner from the sump to the photoreceptor.

2 Claims, 3 Drawing Sheets

ULTRASONICS TRAVELING WAVE FOR TONER TRANSPORT

BACKGROUND OF THE INVENTION

This invention relates generally to the development system in an electrophotographic printing machine, and more particularly, to the use of ultrasonics for toner charge and transport.

Single component xerographic development systems hold the promise of simpler and more reliable performance of lower cost than two component systems. Yet in comparison with two component systems, a single component system often falls short because the toner may have too low a charge level or too broad a distribution, making background control difficult. Also, some single component systems require magnetic toners for transport and applications in color are therefore limited. In addition, singe component systems often require conductive toner for charging and then have transfer problems and generally do not flow as well as two component developers.

It is known in the prior art to use sonic vibrations to facilitate the movement of particles along a sloping surface. For example, U.S. Pat. No. 3,637,115 discloses a sound transmitter to provide sound oscillations for vibrating a fixedly mounted diaphragm for sliding material down a sloping surface. It is also known to use a magnetically driven agitator to dispense particles. For example, U.S. Pat. No. 4,188,907 discloses an apparatus in which particles are dispensed from an open ended chamber. An oscillatory magnetic field vibrates a magnetic member at least partially immersed in the particles to prevent bridging and caking of the particles to facilitate the flow of the particles from the open end of the chamber. None of these references, however, are directed to the above mentioned problems in single component development systems. U.S. Pat. No. 4,546,722 discloses the use of a piezoelectric device on the inside of a developer sleeve at the nip of the developer station to propel toner toward an electrostatic latent image.

It would be desirable, therefore, to provide a development process that can use non-magnetic toners and where the charge levels will be higher and the distribution narrower than is commonly known. It would also be desirable to provide a development system that minimizes the need for moving parts and that provides improved flowability and eliminates the need for fluffing mechanisms in the system. Accordingly, it is an object of the present invention to improve single component development by providing an ultrasonic transducer for charging and transporting the toner. Further advantages of the present invention will become apparent as the following description proceeds and the features characterizing the invention will be pointed out with particularity and the claims annexed to and forming a part of this specification.

SUMMARY OF THE INVENTION

Briefly, the present invention is a single component development system including a housing with a sump containing a supply of toner, an ultrasonic tranducer having one end extending into the source of the toner and the other end disposed adjacent a photoreceptor and a current source electrically connected to the ultrasonic transducer for providing a standing wave pattern along the transducer to charge the toner and move the toner from the sump to the photoreceptor.

DESCRIPTION OF THE DRAWING

For a better understanding of the present invention, reference may be had to the accompanying drawings wherein the same reference numerals have been applied to like parts and wherein.

DESCRIPTION OF THE PREFERRED EMBODIMENT

Figure 1:
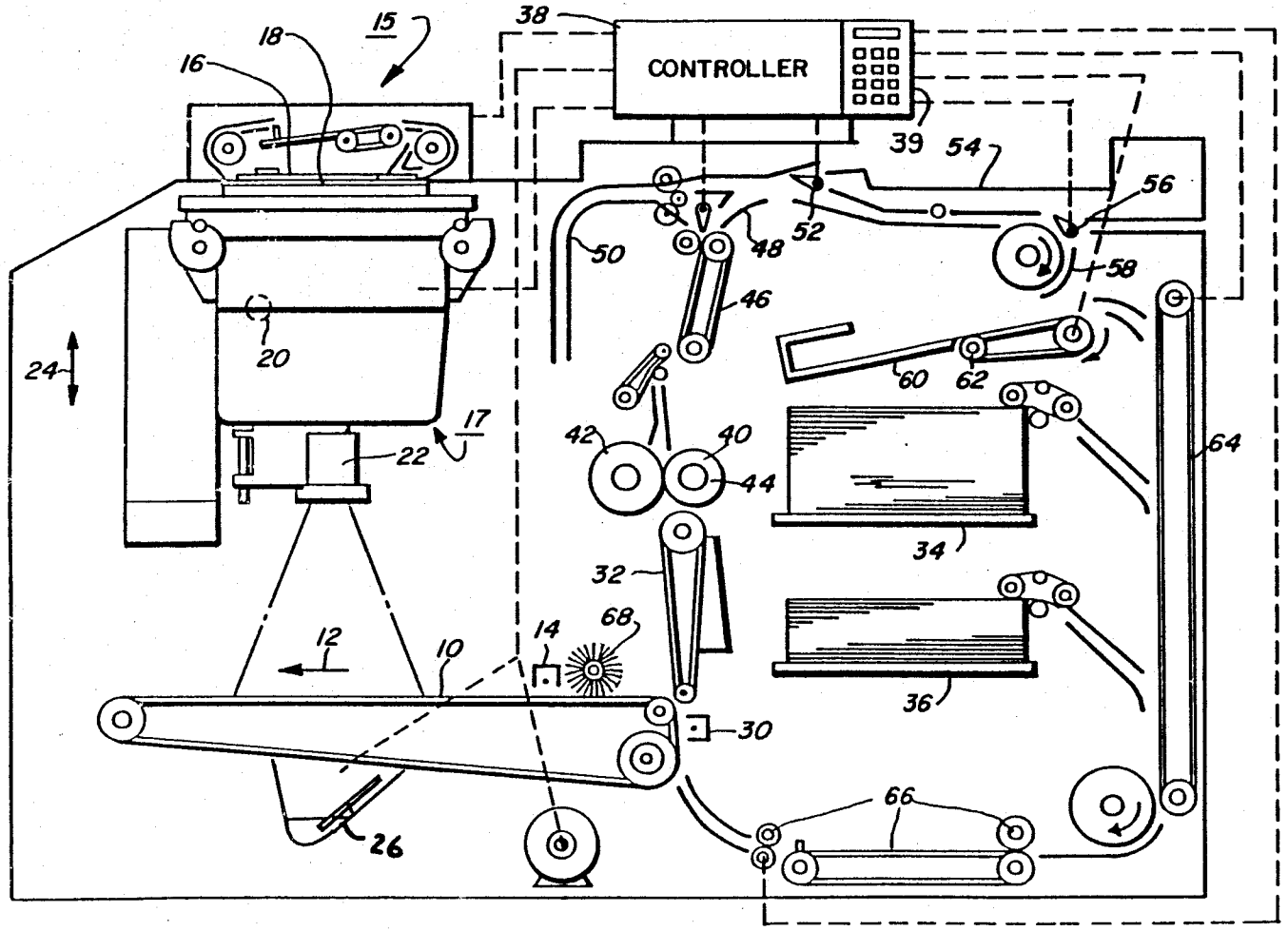
FIG. 1 is an elevational view of a reproduction machine typical of the type of machine incorporating the present invention.

With reference to FIG. 1, there is shown an electrophotographic printing or reproduction machine employing a belt 10 having a photoconductive surface. Belt 10 moves in the direction of arrow 12 to advance successive portions of the photoconductive surface through various processing stations, starting with a charging station including a corona generating device 14. The corona generating device charges the photoconductive surface to a relatively high substantially uniform potential.

The charged portion of the photoconductive surface is then advanced through an imaging station. At the imaging station, a document handling unit 15 positions an original document 16 face down over exposure system 17. The exposure system 17 includes lamp 20 illuminating the document 16 positioned on transparent platen 18. The light rays reflected from document 16 are transmitted through lens 22. lens 22 focuses the light image of original document 16 onto the charged portion of the photoconductive surface of belt 10 to selectively dissipate the charge. This records an electrostatic latent image on the photoconductive surface corresponding to the informational areas contained within the original document.

Document handling unit 15 sequentially feeds documents from a holding tray, in seriatim, to platen 18. The document handling unit recirculates documents back to the stack supported on the tray. Thereafter, belt 10 advances the electrostatic latent image recorded on the photoconductive surface to a development station. At the development station, a developer device 26, as will be described in detail with reference to FIG. 2, in accordance with the present invention advances toner material into contact with the electrostatic latent image.

After the electrostatic latent image recorded on the photoconductive surface of belt 10 is developed, belt 10 advances the toner powder image to the transfer station. At the transfer station a copy sheet is moved into contact with the toner powder image. The transfer station includes a corona generating device 30 which sprays ions onto the backside of the copy sheet. This attracts the toner powder image from the photoconductive surface of belt 10 to the sheet.

The copy sheets are fed from a selected one of trays 34 to 36 to the transfer station. After transfer, conveyor 32 advances the sheet to a fusing station. The fusing station includes a fuser assembly 40 for permanently affixing the transferred powder image to the copy sheet.

Preferably, fuser assembly 40 includes a heated fuser roller 42 and backup roller 44 with the sheet passing between fuser roller 42 and backup roller 44 with the powder image contacting fuser roller 42.

After fusing, conveyors 46 transports the sheets to gate 48 which functions as an inverter selector. Depending upon the position of gate 48, the copy sheets will either be deflected into a sheet inverter 50 or bypass sheet inverter 50 and be fed directly onto a second gate 52. Decision gate 52 deflects the sheet directly into an output tray 54 or deflects the sheet into a transport path which carries them on without inversion to a third gate 56. Gate 56 either passes the sheets directly on without inversion into the output path of the copier, or deflects the sheets into a duplex inverter roll transport 58. Inverting transport 58 inverts and stacks the sheets to be duplexed in a duplex tray 60. Duplex tray 60 provides intermediate or buffer storage for those sheets which have been printed on one side for printing on the opposite side.

Invariably after the copy sheet is separated from the photoconductive surface of belt 10, some residual particles remain adhering to belt 10. These residual particles are removed from the photoconductive surface thereof at a cleaning station. The cleaning station includes a rotatably mounted fibrous brush 68 in contact with the photoconductive surface of belt 10. A controller 38 and control panel 39 are also illustrated in FIG. 1. The controller 38, as represented by dotted lines, is electrically connected to the various components of the printing machine.

Figure 2:
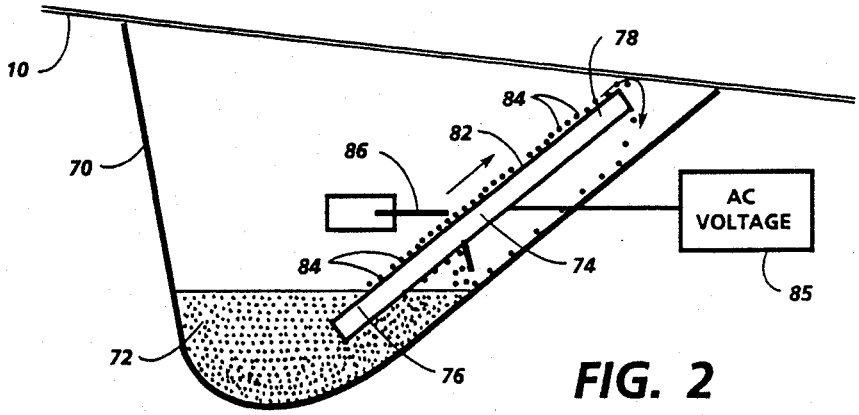
FIG. 2 is illustrates the ultrasonically driven single component development station in accordance with the present invention.

With reference to FIG. 2, the developer device 26 is illustrated in more detail. In particular, the developer device 26 includes a housing 70 disposed near the belt 10 and including a sump section 72 carrying a supply of toner. An ultrasonic transducer 74 extends upwardly from the sump section 72 to a point adjacent the belt 10 having one end 76 imbedded in the supply of toner and having the opposite end 78 positioned adjacent the belt 10 for passage of the toner to the latent image on the belt. A suitable source 85 of AC current is electrically connected to the ultrasonic transducer 74 such as a piezoelectric device to initiate a vibrating motion in the transducer. By suitable choice of the transducer 74 and the exciting current source 85 a vibrating wave can be induced into the transducer. It has been observed that toner particles, on an ultrasonically driven surface, will move rapidly from a wave antinode to a wave node and the toner particles will go from an uncharged to a charged state. The significance of this observation is that even uncharged toner particles can be used as the source of toner and that magnetic loadings in the toner are not required for transport. It has also been found that toner particles can be transported against gravity, generally walking up inclines greater than 45°.

Preferably, the transducer is induced with a standing wave pattern having a single linear node at the end 78 and a single linear antinode at the end 76. Preferably, the transducer 74 is coated on the top surface 82 with a plastic or any other suitable material to facilitate the development of a triboelectric charge on the toner particles as illustrated at 84 as they are conveyed up the surface 82 of the transducer. It should be noted that a blade 86 may be provided to establish the height of the toner particles 84 that are conveyed up the surface of the transducer 74 and in some cases the blade can be biased if necessary to enhance the charge on the toner particles 84.

Thus, in operation, uncharged toner will walk up an ultrasonically driven ramp with a standing wave that has an antinode at the bottom of the ramp and a node at the top of the ramp. With the end 76 of the transducer 74 imbedded in the toner in the sump 72 and the transducer suitably excited by the current source 85 to provide a node at the top 78 of the transducer and an antinode at the bottom 76, toner particles 84 will be conveyed up the surface 82 of the transducer to the end 78 to develop the image on the belt 10. As illustrated, tone particles not adhering to the latent image on the belt 10 drop back to the sump 72 due to the effects of gravity.

Once the charged toner particles 84 have been driven close to the image charge, any suitable development means can be used. For example, development can occur by the use of normal back biasing to AC biased "jumping toner" methods. It should also be noted that a donor roll can be used for relay of the toner particles to an image bearing belt or drum.

Figure 3A:
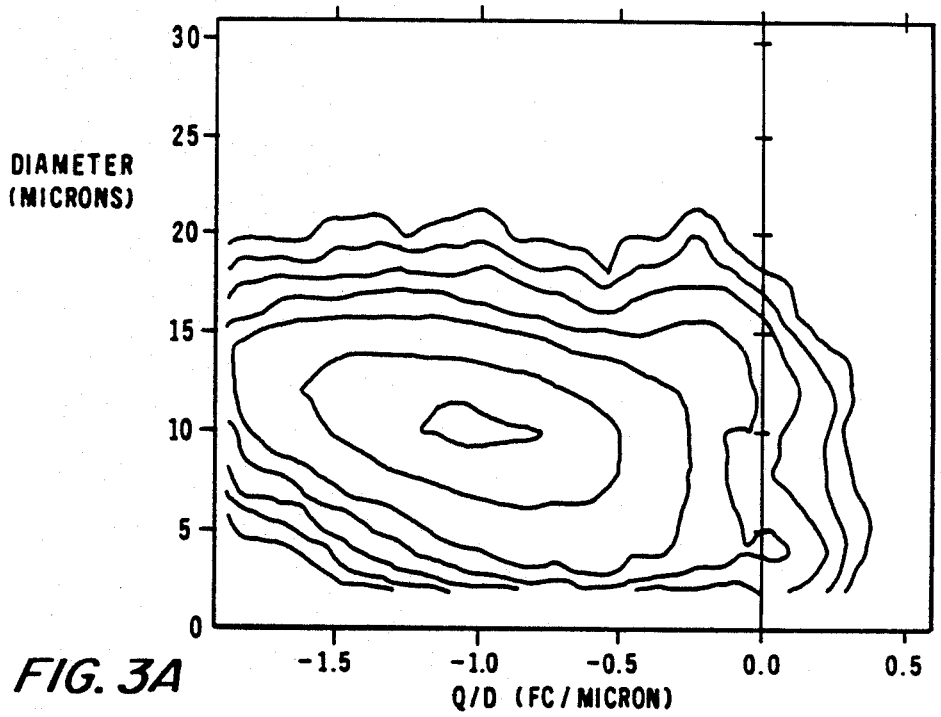
FIGS. 3*a* and 3*b* illustrate plots of toner charge and toner size as provided in accordance with the present invention.
Figure 3B:
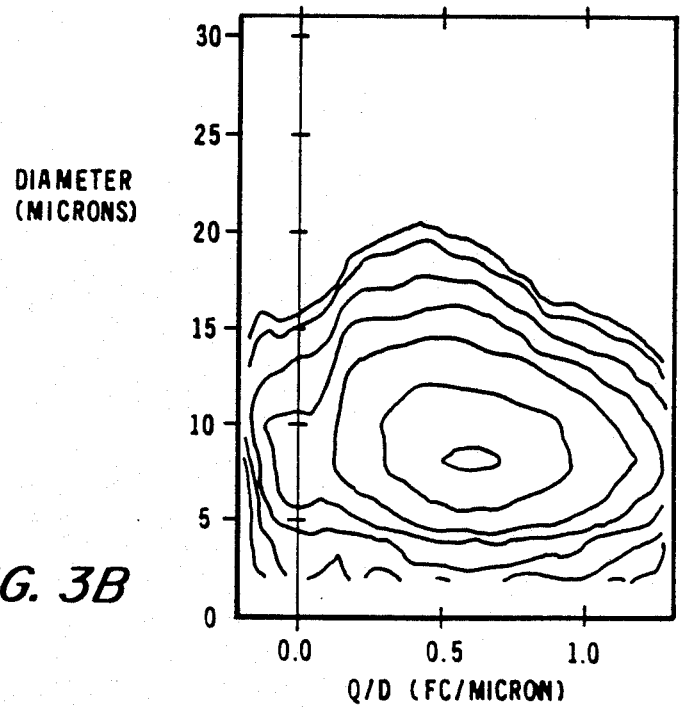

With reference to FIGS. 3*a* and 3*b* there is illustrated contour plots of the size of the toner in relation to the charge on the toner. Specifically, the vertical axis in each of the Figures plots the diameter of the toner in microns and the horizontal axis plots the ratio of the charge in coulombs to the diameter of the toner in microns. In FIG. 3*a* the toner was charged negative and in FIG. 3*b*, the toner was charged positive. The toners were charged against glass using ultrasonic vibrations at 40 KHz. It should also be understood that composite transducers can be fabricated to dissipate heat in the transducer to prevent toner caking or melting. It is also contemplated within the scope of this invention to locate the ultrasonic transducer within a donor or photoreceptor roll or behind a belt and then couple through to the toner source. Configurations using an active piezoelectric rotating cylinder are also possible.

To provide a longer toner transport path or higher ultrasonic drive in the development zone, in accordance with another feature of the present invention, at raveling ultrasonic wave can be used. With proper implementations, the transport path length will not be restricted by wave length consideration and there will ultrasonic agitation in the development nip or gap.

An ultrasonic traveling wave can be generated by stacking a multitude of transducers and then driving each with the proper phase shift. It is also possible to modulate the clamping points on an ultrasonic transducer, for example, using piezoelectric mounts, in order to propagate the desired traveling ultrasonic wave. It may also be possible to achieve the desired effected by stepping the frequency to properly chosen discrete points in rotation.

Figure 4:
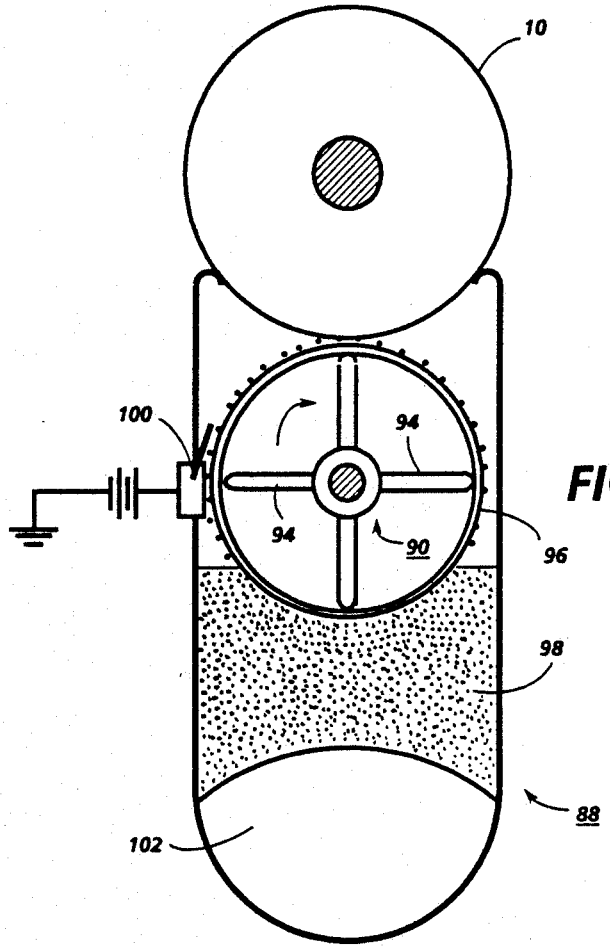

With reference to FIG. 4, there is illustrated a means to mechanically generate the traveling ultrasonic wave. An ultrasonically driven development station generally illustrated in 88 is shown with respect to an image bearing surface 10 (or donor surface). An ultrasonic transducer illustrated at 90 suitably connected to a not shown A.C. voltage source is composed of a piezoelectric enter cylinder with four blades 94 and rotated within a stationary sleeve 96. The ultrasonically driven blades 94 are in wiping contact with the inside diameter of the sleeve 96. It should be noted that it may be necessary to use spring pressure, contact grease or other means to increase the coupling between the stationary sleeve 96 and the rotating blades 94.

Points on the sleeve 96 just adjacent to the rotating transducer blades 94 are expected to be more active than other points. Thus toner will be driven towards a moving node and a traveling ultrasonic wave will drive the system. Care must be taken so that the sleeve is not resonant at the transducer drive frequency—otherwise the antinodes will not be controlled to the blade locations as desired.

Toner will move from the toner supply 98 around the stationary sleeve 96 through the development nip or gap and finally returning to the sump or toner supply 8. Toner is also expected to charge as it is transported because sleeve surfaces are selected to be tribo active with respect to the toner. A biased blade, as illustrated at 100, can be located in the toner path to enhance charging or to control pile height. Toner charge distributions will be enhanced by the thousands of contacts generated by the ultrasonic vibrations. It is also expected that the ultrasonics in the development nip (or gap) will improve toner transfer to the image (or to a donor for relay to an image).

The stationary sleeve simplifies containment of toner, as no moving seals are required in the sump. (forced air or convection through the open ends of the sleeve will provide cooling for the transducer and reduce heat transfer to the toner sump.) For coupling as well as cooling the cavity could be filled with liquid. To insure a toner supply, a deep sump with the means to elevate the toner can be used such as an inflatable bladder 102 with a (not shown) small solenoid driven bellows.

While there has been illustrated and described what is at present considered to be a preferred embodiment of the present invention, it will be appreciated that numerous changes and modifications are likely to occur to those skilled in the art, and it is intended in the appended claims to cover all those changes and modifications which fall within the true spirit and scope of the present invention.

We claim:

1. In a reproduction machine having an image bearing member supporting a latent image, a single component development system for rendering the latent image visible comprising a housing located in the vicinity of the image bearing member and having a sump portion, a source of toner disposed within the sump portion, an ultrasonic transducer having one segment extending into the source of toner and another segment disposed adjacent the image bearing member, a current source electrically connected to the ultrasonic transducer for providing a standing wave pattern along the transducer, a surface of the transducer providing a platform for charging the toner and moving the toner from the sump to the image bearing member, the toner contacting the image bearing member to render the latent image visible and including means to generate a traveling ultrasonic wave on the transducer including a stationary sleeve and a rotating transducer with a plurality of blades secured thereto rotating within said sleeve, a segment of the sleeve disposed adjacent the image bearing surface.

2. The development system of claim 1 wherein the transducer is coated with a plastic material to tribo-electrically charge the toner.

* * * * *